US008128346B2

(12) United States Patent
Yu

(10) Patent No.: US 8,128,346 B2
(45) Date of Patent: Mar. 6, 2012

(54) FAN WITH CONCEALED 360-DEGREE OSCILLATING MECHANISM

(76) Inventor: Steven Yu, Los Angeles, CA (US)

( * ) Notice: Subject to any disclaimer, the term of this patent is extended or adjusted under 35 U.S.C. 154(b) by 391 days.

(21) Appl. No.: 12/560,775

(22) Filed: Sep. 16, 2009

(65) Prior Publication Data

US 2011/0064577 A1 Mar. 17, 2011

(51) Int. Cl.
*F03B 15/02* (2006.01)

(52) U.S. Cl. ..... 415/121.2; 415/125; 415/126; 416/100; 416/110; 416/170 R; 417/423.1

(58) Field of Classification Search ..... 416/100, 416/170 R, 172, 247 R, 110; 415/126, 121.2, 415/125; 417/423.1

See application file for complete search history.

(56) References Cited

U.S. PATENT DOCUMENTS 6,171,057 B1 * 1/2001 Chen ..... 416/100
7,771,167 B2 * 8/2010 Fu ..... 416/100
2008/0304969 A1 * 12/2008 Fu ..... 416/148

* cited by examiner

*Primary Examiner* — Edward Look
*Assistant Examiner* — Christopher R Legendre
(74) *Attorney, Agent, or Firm* — Rabin & Berdo, PC

(57) ABSTRACT

A fan with concealed 360-degree oscillating mechanism includes a main housing; a pivot member vertically, pivotally and turnably mounted in the housing; a first driving motor having a forward first rotary shaft and horizontally, pivotally and turnably mounted in the pivot member; an oscillating mechanism assembled between the first driving motor and a rear end face of the main housing, and having a first end driving an opposing second end to rotate eccentrically; and a set of blades fixedly connected to the first rotary shaft to locate in front of the main housing. With the first driving motor pivotally connected to the pivot member and eccentrically connected to the oscillating mechanism, the set of blades can be oscillated 360 degrees while being rotated by the first driving motor; and parts inside the main housing undertake force evenly to enable stable operation of the fan and reduced stress fatigue of the oscillating mechanism.

12 Claims, 11 Drawing Sheets

FAN WITH CONCEALED 360-DEGREE OSCILLATING MECHANISM

FIELD OF THE INVENTION

The present invention relates to a fan having an oscillating mechanism, and more particularly to a fan having an oscillating mechanism that is concealed in a main housing of the fan to enable a set of blades of the fan to oscillate 360 degrees while rotating.

BACKGROUND OF THE INVENTION

An electric fan usually includes a set of blades having a curved configuration each. The set of blades is driven by a driving motor to rotate, so that air is sucked into the fan from one side of the blades and then blown out of the fan from the other side of the blades to thereby produce airflow toward a target object. However, the blades can only produce linearly moved airflow. To direct the linearly moved airflow produced by the fan to different directions, an oscillating mechanism must be additionally provided for the fan.

According to the oscillating mechanisms thereof, the currently available fans can be generally divided into two types, namely, a cover-rotating fan and an oscillating fan.

The cover-rotating fan includes an air guiding mechanism arranged at a front side of the overall fan structure. The air guiding mechanism normally includes a plurality of parallelly spaced tilted slats. When the air guiding mechanism is rotated, the originally linearly moved airflow produced by the fan meets the rotating tilted slats and is automatically directed to different flowing directions to thereby produce a widened breezy area.

To achieve the purpose of directing the airflow to different directions, the tilted slats of the air guiding mechanism for the fan are usually densely arranged. Dust tends to accumulate in the small spaces between the densely arranged tilted slats, and the densely arranged tilted slats would adversely restrict the range of airflow to result in lowered cooling efficiency. Therefore, such air guiding mechanism is not suitable for use with a fan system designed to produce a large airflow.

The oscillating fan is a fan provided in a base thereof with a rotary mechanism for producing an oscillating motion of the fan. That is, the rotary mechanism reciprocatingly rotates a main shaft of the fan to thereby change the direction of the produced airflow. When the oscillating fan operates, the whole fan oscillates about the rotary mechanism to swing to and fro sidewardly within a large span.

However, the sideward oscillation of the fan within a large span does not guide the airflow upward and downward. Therefore, the sideward oscillating fan is not suitable for some special working environment that requires vertical airflow. Further, the rotary mechanism of the oscillating fan has a gear set that is subject to wearing due to unbalanced weight undertaken by the rotary mechanism. The worn-out gear set results in a fan that tends to jig or halt during oscillating and accordingly has reduced operating efficiency and shortened service life.

On the other hand, most of the current industrial fans have metal-made blades and a powerful driving motor for rotating the blades at high speed, so as to meet the requirement of producing a large amount of airflow. The conventional oscillating fan and cover-rotating fan have a structure that fails to meet the requirement of the industrial fans. For the purpose of directing the airflow produced by the general industrial fan to different directions, the industrial fan is normally manually oriented to different directions. When orienting the industrial fan to different directions with a hand, there is a potential risk in the safety of using the industrial fan because the operator's hand might touch and be injured by the metal blades of the fan. Therefore, the conventional industrial fans have relatively low applicability.

In conclusion, the conventional fans, no matter what type of rotary mechanism is adopted, have the disadvantage of limited airflow direction or non-adjustable airflow direction. To overcome the above disadvantage, there is a developed fan structure for leading airflow to upper and lower sides of the fan. For example, US Patent Publication No. 2008/0304969 discloses a built-in swing mechanism of rotary fan. Please refer to FIG. 1. According to the specification of US Patent Publication No. 2008/0304969, the rotary fan has a main casing 10, a built-in swing mechanism 11 located in a main casing 10 of the rotary fan, and a fan driving motor 12. The built-in swing mechanism 11 includes a ball-and-socket support mechanism 13 arranged onto a front wall 101 of the main casing 10, and a crank oscillating mechanism 14 assembled to a rear wall 107 of the main casing 10.

The ball-and-socket support mechanism 13 includes a ball-and-socket support frame 102 arranged onto the front wall 101 of the main casing 10 and a spherical abut seat 106 having a spherical abut surface 105. The ball-and-socket support frame 102 has a spherical supporting surface 103 and a through-hole 104 located at a center of the spherical supporting surface 103 for a spindle 121 of the fan driving motor 12 to extend therethrough. The spherical abut seat 106 has an end coupled with the spherical supporting surface 103 via the spherical abut surface 105, and another opposing end connected to a front end of the fan driving motor 12.

The crank oscillating mechanism 14 includes a crank linkage element 141 assembled between the fan driving motor 12 and the rear wall 107 of the main casing 10. The crank linkage element 141 has a first end that can be driven to enable the oscillation of an opposing second end thereof. The second end of the crank linkage element 141 is assembled to a rotary pivot 142 on the rear wall 107 of the main casing 10 to rotate freely. The first end of the crank linkage element 141 includes a drive plate 146 and an independent motor gearbox 144 having an output shaft 143. The drive plate 146 is provided with an axle hole 145 for the output shaft 143 of the independent motor gearbox 144 to extend therethrough. The independent motor gearbox 144 is connected to a rear end of the fan driving motor 12.

When the built-in swing mechanism 11 of rotary fan operates, the independent motor gearbox 144 drives the crank oscillating mechanism 14 for the latter to bring the fan driving motor 12 to oscillate 360 degrees about the ball-and-socket support mechanism 13 at the front end of the main casing 10, so that the rotary fan can produce and deliver a 360-degree airflow.

However, as a most common problem with this type of rotary fan, the gearbox and the ball-and-socket support mechanism of the swing mechanism are subject to wearing due to unbalanced weight distribution over the swing mechanism. The worn-out gearbox and ball-and-socket support mechanism result in a fan that tends to jig or halt during oscillating and accordingly has reduced operating efficiency and shortened service life.

SUMMARY OF THE INVENTION

A primary object of the present invention is to provide a fan with concealed 360-degree oscillating mechanism, so that a first driving motor of the fan mounted to a pivot member and connected to an oscillating mechanism inside a main housing of the fan and a set of blades connected to the first driving motor can rotate while oscillating 360 degrees to change the direction of a produced airflow. Meanwhile, force produced by the fan during operation thereof is evenly distributed over the first driving motor and parts of the oscillating mechanism to enable stable operation of the fan and reduced stress fatigue of the oscillating mechanism, so that the fan can have upgraded airflow producing efficiency and lowered failure rate.

To achieve the above and other objects, the fan with concealed 360-degree oscillating mechanism according to a preferred embodiment of the present invention includes a main housing, a pivot member located inside the main housing, a first driving motor located inside the main housing, an oscillating mechanism located inside the main housing, and a set of blades located outside the main housing.

The main housing is provided at a front end face with an axially extended through-hole, at each of two opposite lateral inner wall surfaces with a locating element, and at an inner side of a rear end face with a coupling portion. The pivot member includes a hollow and pivotable frame. The hollow and pivotable frame is provided at two opposite lateral sides with two corresponding and outward projected pivot shafts, and at two opposite upper and lower ends with two corresponding pivot holes; and the two pivot shafts are separately engaged with the two locating elements on the main housing to allow the pivot member to vertically swing about the pivot shafts. The first driving motor includes a first rotary shaft forward extending through the through-hole to project from the main housing, and two connecting rods corresponding to and received in the two pivot holes on the upper and lower ends of the hollow and pivotable frame to allow the first driving motor to horizontally swing about the connecting rods relative to the pivot member. The oscillating mechanism is assembled to and between a rear end of the first driving motor and the rear end face of the main housing, and has a first end and an opposing second end. The second end of the oscillating mechanism is connected to the coupling portion on the rear end face of the main housing and is driven by the first end to rotate eccentrically. The set of blades is fixedly connected to the first rotary shaft of the first driving motor.

The main housing is assembled from a front cover and a mating rear cover, and the front cover further includes an upper front cover and a lower front cover that together define the through-hole therebetween. The oscillating mechanism includes a second driving motor and a crank linkage element. The second driving motor is connected to the rear end of the first driving motor, and has a second rotary shaft parallel to the first rotary shaft, so that the second rotary shaft is eccentric relative to the first rotary shaft. The crank linkage element has a first end connected to the second rotary shaft of the second driving motor and a second end assembled to the coupling portion.

In a preferred embodiment, the crank linkage element is provided at the first end with a shaft hole for receiving the second rotary shaft therein, and at the second end with a spherical support seat; and the coupling portion is in the form of a spherical socket corresponding to the spherical support seat, so that the spherical socket and the spherical support seat together constitute a ball-and-socket coupling.

In another preferred embodiment, the crank linkage element is in the form of a curved link bar having a first end and an opposing second end, and the coupling portion is in the form of a connecting shaft. The curved link bar is provided at the first end with a shaft hole for receiving the second rotary shaft, and at the second end with a connecting hole for correspondingly and rotatably receiving the connecting shaft therein.

The fan is provided with an oscillation control switch electrically connected to the second driving motor for controlling an operating state of the second driving motor, and a volume control switch electrically connected to the first driving motor for controlling a rotary speed of the set of blades. In a preferred embodiment, the oscillation control switch and the volume control switch are located on the rear end face of the main housing.

The fan further includes a hood structure connected to and fitted around the main housing, and a stand externally connected to the hood structure. The hood structure internally defines a forward extended oscillation space for enclosing a front portion of the main housing and the set of blades therein. The hood structure is assembled from a first hood and a second hood. The first hood is provided with a fitting opening corresponding to the main housing, so that the main housing is extended through the fitting opening and assembled to the first hood at the fitting opening; and the second hood is configured corresponding to the first hood and assembled to a front side of the first hood to define the oscillation space between the first and the second hood. The stand includes two supporting bars connected to two lateral sides of the hood structure, and a base extended between lower ends of the two supporting bars to thereby stably support and position the fan on a floor for use.

The fan of the present invention is characterized in that the first driving motor is connected to the pivot member and the oscillating mechanism, so that the set of blades can be driven by the first driving motor to oscillate 360 degrees while rotating to deliver produced airflow to different directions. Meanwhile, since the first driving motor is supported by the pivot member and the oscillating mechanism, the force produced by the first driving motor during oscillating is evenly distributed to and undertaken by the pivot member and the oscillating mechanism, enabling the fan to operate stably and reducing the stress fatigue of the oscillating mechanism, so that the fan has upgraded airflow producing efficiency and reduced failure rate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
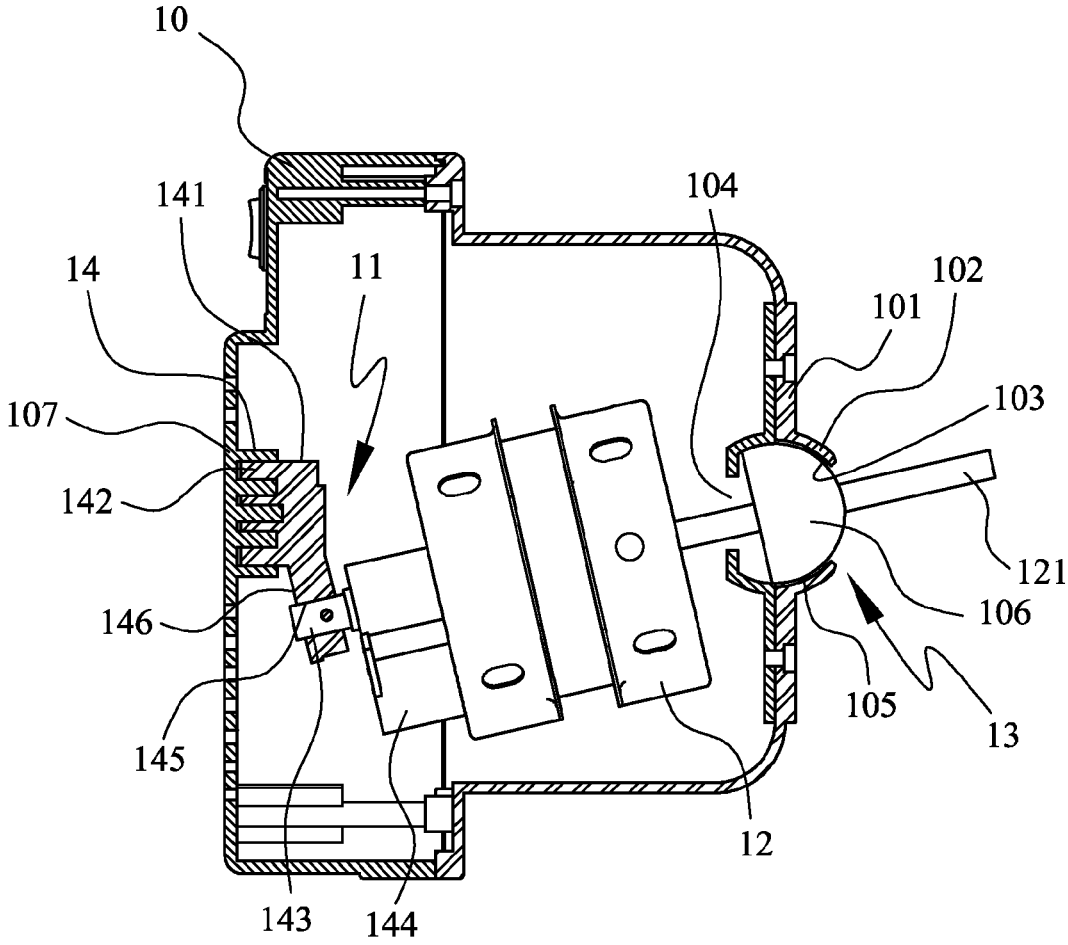
FIG. 1 (Prior Art)
FIG. 1 is a sectioned side view of a conventional built-in swing mechanism for rotary fan.
Figure 2:
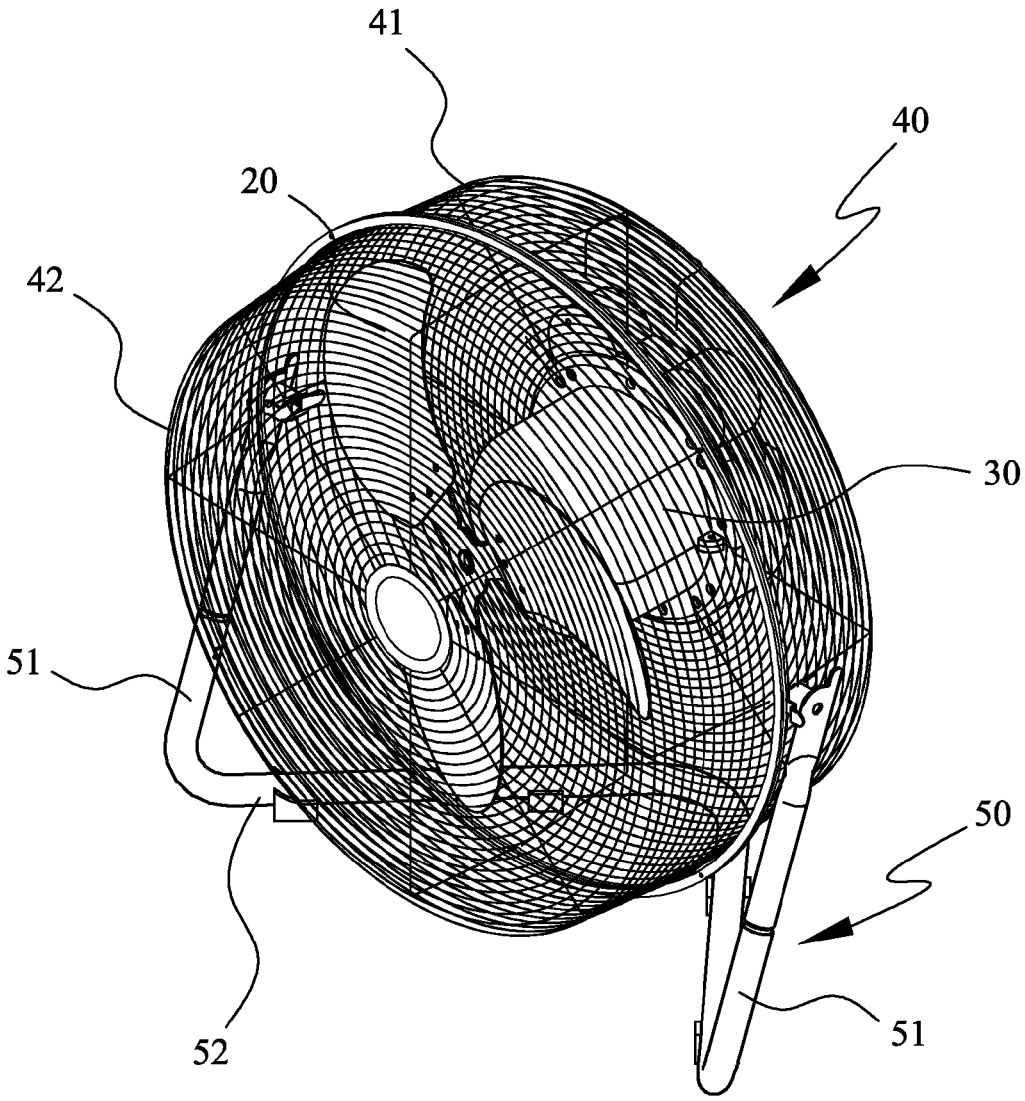
FIG. 2 is an assembled front perspective view of a fan with concealed 360-degree oscillating mechanism according to a preferred embodiment of the present invention.
Figure 3:
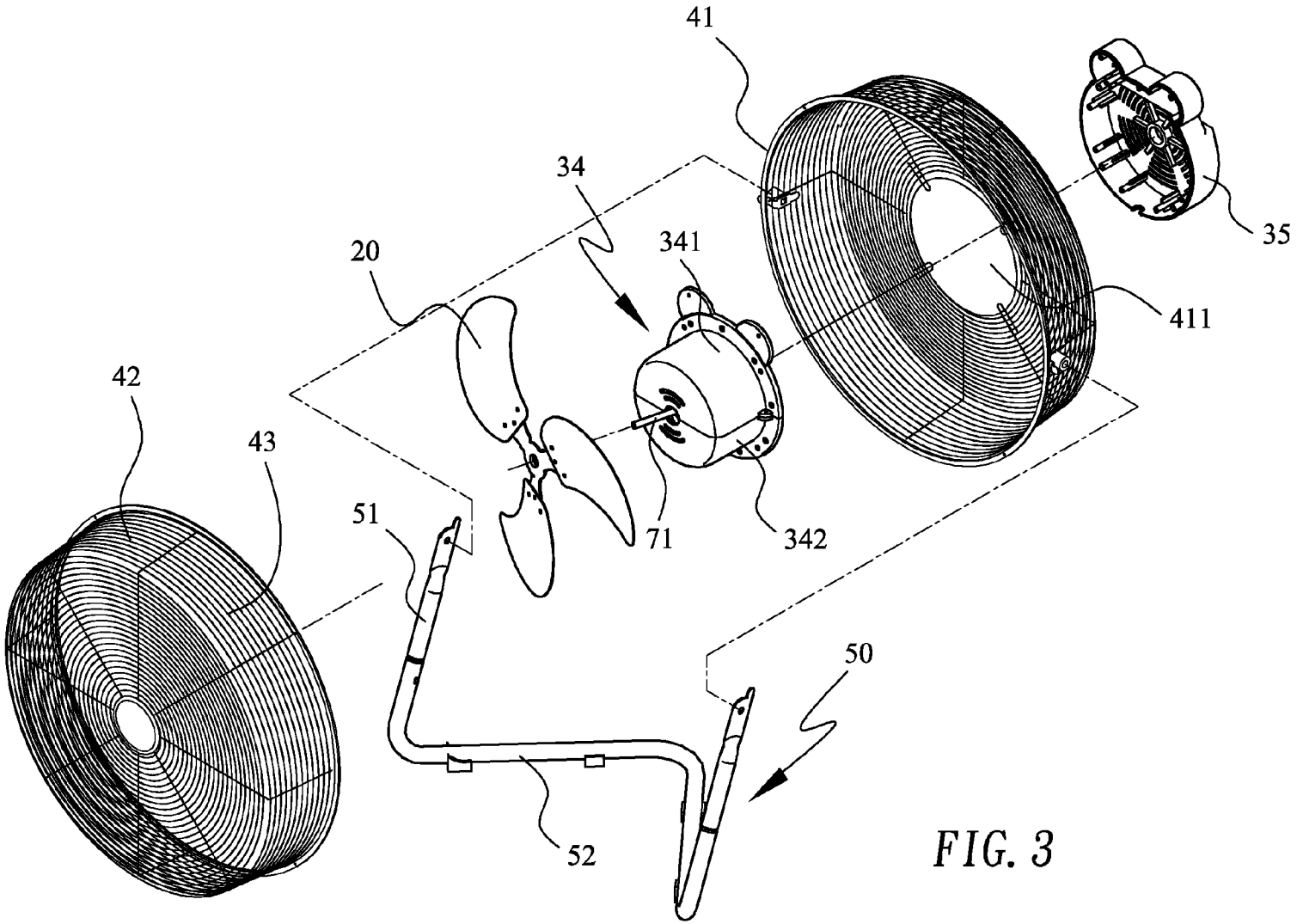
FIG. 3 is an exploded view of FIG. 2.

Please refer to FIGS. 2 and 3 that are assembled and exploded front perspective views, respectively, of a fan with concealed 360-degree oscillating mechanism according to a preferred embodiment of the present invention, which, as shown, includes a set of blades 20, a main housing 30 having a driving mechanism received therein, a hood structure 40, and a stand 50. The set of blades 20 is connected to the driving mechanism inside the main housing 30 that is assembled to and enclosed in the hood structure 40. The stand 50 is connected to an outer side of the hood structure 40 to stably position the whole fan on a floor for use.

Figure 4:
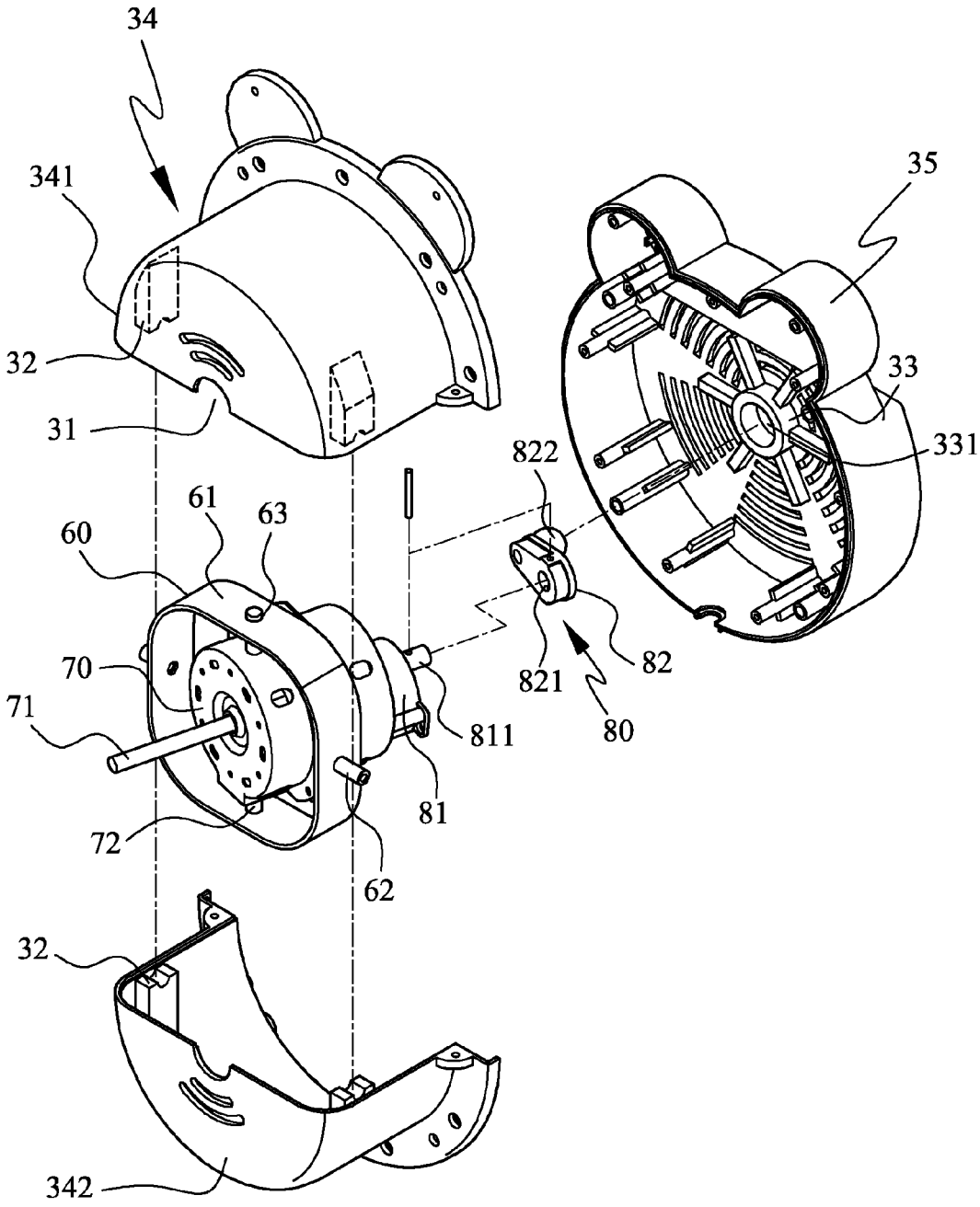
FIG. 4 is a front exploded perspective view of a main housing for the fan of the present invention.
Figure 5:
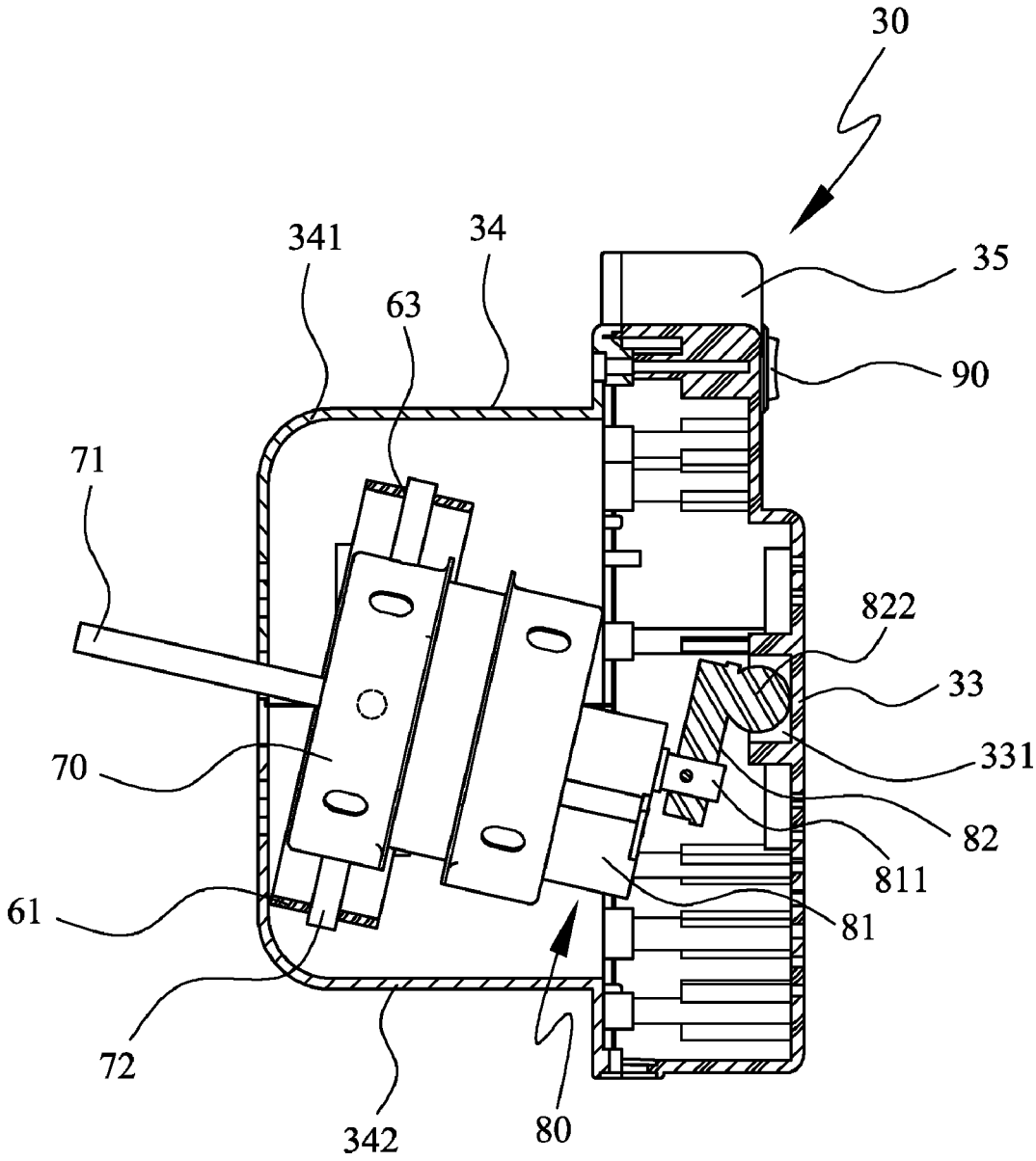
FIG. 5 is an assembled sectioned side view of FIG. 4.
Figure 6:
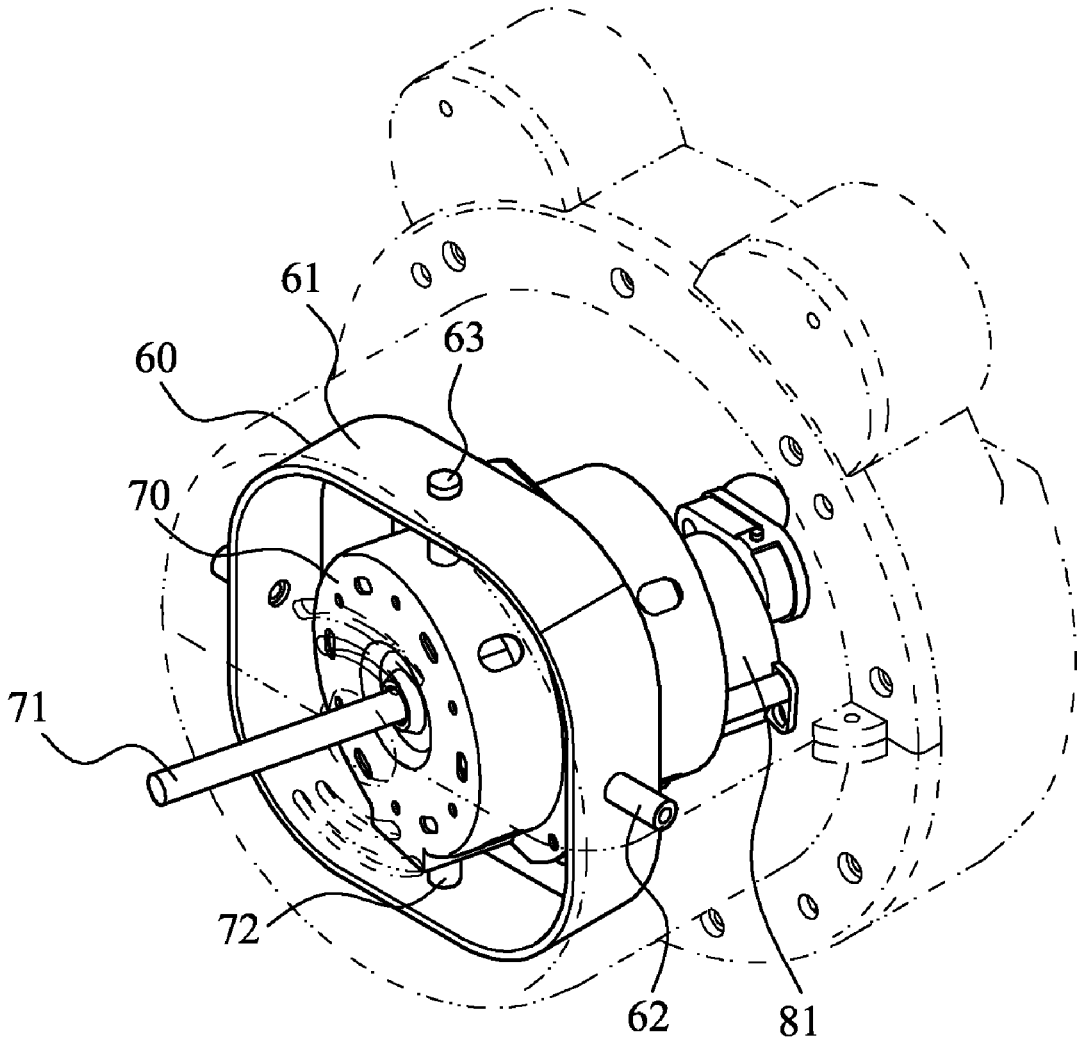
FIG. 6 is an assembled phantom perspective view of FIG. 4.

Please refer to FIGS. 4, 5 and 6 at the same time. The main housing 30 is provided at a front end face with an axially extended through-hole 31, at each of two opposite lateral inner wall surfaces with a locating element 32, and at an inner side of a rear end face with a coupling portion 33. In the illustrated preferred embodiment, the main housing 30 is assembled from a front cover 34 and a mating rear cover 35.

The front cover 34 further includes an upper front cover 341 and a lower front cover 342 that together define the through-hole 31 therebetween.

The driving mechanism inside the main housing 30 includes a pivot member 60, a first driving motor 70, and an oscillating mechanism 80. The pivot member 60 includes a hollow and pivotable frame 61. The hollow and pivotable frame 61 is provided at two opposite lateral sides with two corresponding and outward projected pivot shafts 62, and at two opposite upper and lower ends with two corresponding pivot holes 63. The two pivot shafts 62 separately engage with the two locating elements 32 to allow the pivot member 60 to vertically swing about the pivot shafts 62 in the front cover 34 under control.

The first driving motor 70 includes a first rotary shaft 71 forward extending through the through-hole 31 to project from the main housing 30, and two connecting rods 72 corresponding to and received in the two pivot holes 63 on the upper and lower ends of the hollow and pivotable frame 61 to allow the first driving motor 70 to horizontally swing about the connecting rods 72 relative to the pivot member 60.

The oscillating mechanism 80 is assembled to and between a rear end of the first driving motor 70 and the rear end face of the main housing 30. The oscillating mechanism 80 has a first end and an opposing second end, and the second end is driven by the first end to rotate eccentrically. The second end of the oscillating mechanism 80 is connected to the coupling portion 33 on the rear end face of the main housing 30.

In the illustrated preferred embodiment, the oscillating mechanism 80 includes a second driving motor 81 and a crank linkage element 82. The second driving motor 81 is connected to the rear end of the first driving motor 70, and has a second rotary shaft 811 parallel to the first rotary shaft 71. Therefore, the second rotary shaft 811 is eccentric relative to the first rotary shaft 71. The crank linkage element 82 has a first end connected to the second rotary shaft 811 of the second driving motor 81 and a second end assembled to the coupling portion 33.

The first end of the crank linkage element 82 is provided with a shaft hole 821 for receiving the second rotary shaft 811 therein, and the second end of the crank linkage element 82 is provided with a spherical support seat 822. Meanwhile, the coupling portion 33 is in the form of a spherical socket 331 corresponding to the spherical support seat 822, such that the spherical socket 331 and the spherical support seat 822 together constitute a ball-and-socket coupling, via which the crank linkage element 82 is allowed to rotate 360 degrees.

Figure 7:
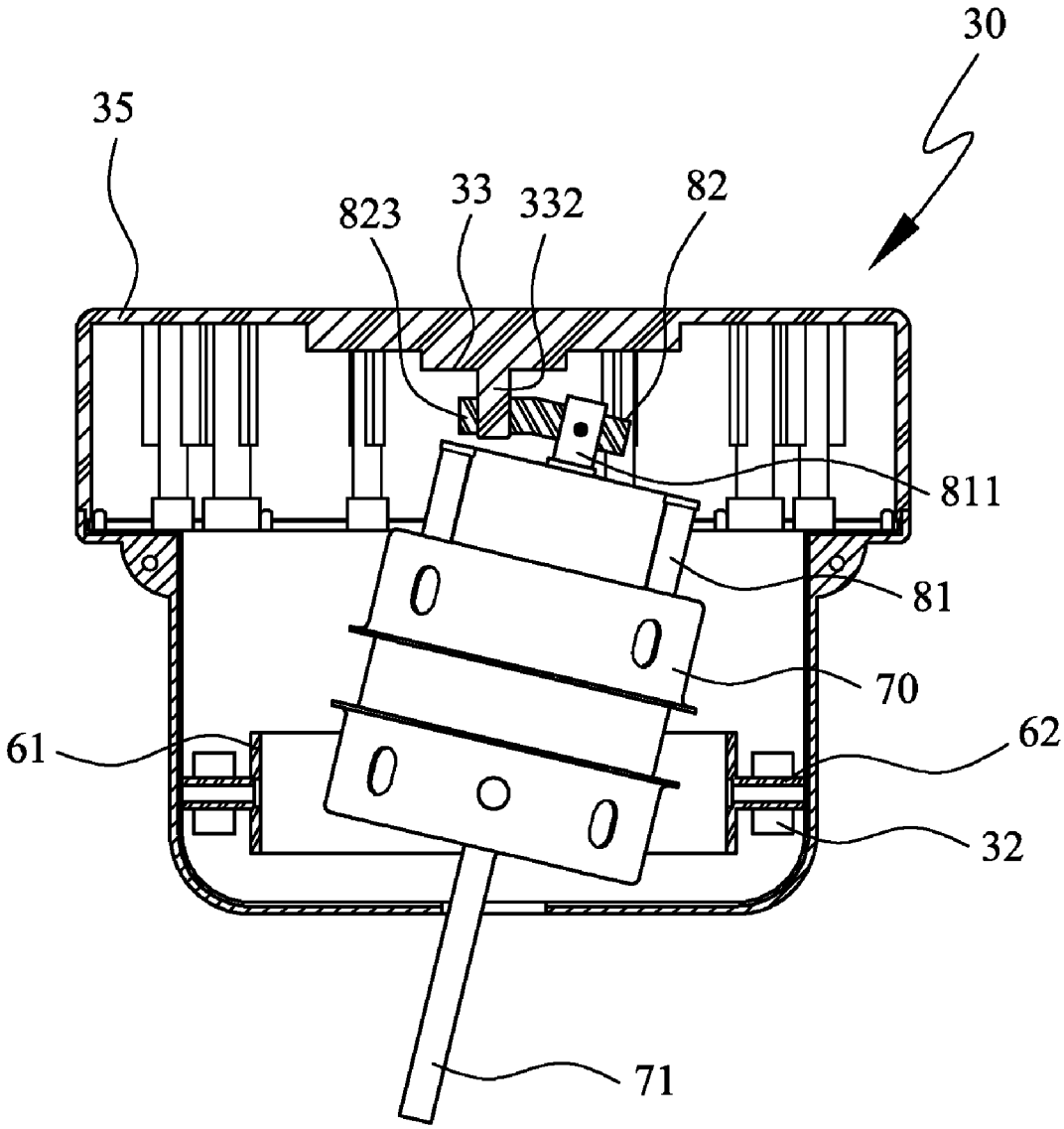
FIG. 7 is a sectioned top view of the main housing for the fan of the present invention, showing a crank linkage element in the form of a curved link bar is used.

Please refer to FIG. 7. In another preferred embodiment of the present invention, the crank linkage element 82 is in the form of a curved link bar 823. The curved link bar 823 is provided at a first end with a shaft hole for receiving the second rotary shaft 811, and at an opposing second end with a connecting hole. Meanwhile, in this embodiment, the coupling portion 33 is in the form of a connecting shaft 332 corresponding to and received in the connecting hole, allowing the curved link bar 823 to pivotally rotate about the connecting shaft 332. In this manner, the second driving motor 81 is brought by the curved link bar 823 to oscillate.

In an ideal embodiment, the fan is provided with an oscillation control switch 90 (see FIG. 5) electrically connected to the second driving motor 81 for controlling the operation of the second driving motor 81. The fan is also provided with a volume control switch 91 (see FIG. 9) electrically connected to the first driving motor 70 for controlling the rotary speed of the set of blades 20. In an operable embodiment, the oscillation control switch 90 and the volume control switch 91 are provided on the rear end face of the main housing 30.

Please refer to FIGS. 2 and 3 again. The hood structure 40 is connected to and fitted around the main housing 30, and internally defines a forward extended oscillation space 43 large enough for enclosing a front portion of the main housing 30 and the set of blades 20 therein. In the illustrated preferred embodiment, the hood structure 40 is assembled from a first hood 41 and a second hood 42. The first hood 41 is provided with a fitting opening 411 corresponding to the main housing 30, so that the main housing 30 can be extended through the fitting opening 411 and assembled to the first hood 41 at the fitting opening 411. The second hood 42 is configured corresponding to and assembled to a front side of the first hood 41, so that the first and the second hood 41, 42 together define the oscillation space 43 between them.

The stand 50 is externally assembled to the hood structure 40 to stably position the whole fan on a floor for use. In the illustrated preferred embodiment, the stand 50 includes two extended supporting bars 51 connected to two lateral sides of the hood structure 40, and a base 52 extended between lower ends of the two supporting bars 51 to stably position the fan on a floor for use. While the illustrated stand 50 is designed for stably positioning the whole fan on a floor for use, it is understood the stand 50 is not necessarily limited to the above described configuration. Instead, the stand 50 can be otherwise a suspender hanging from a ceiling, a mount fixed on a wall or the like to meet different requirements for using the fan.

Figure 8:
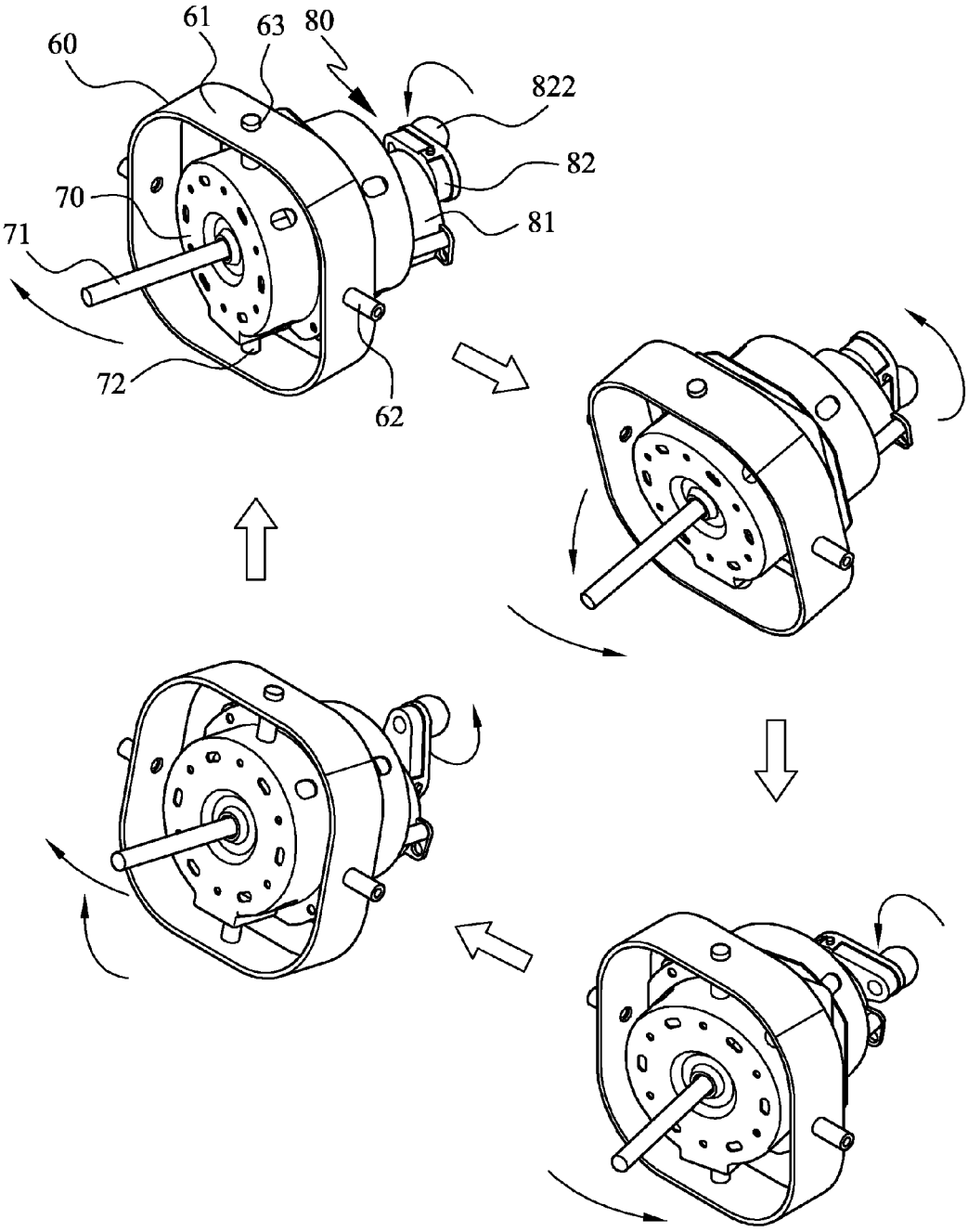
FIG. 8 shows a first driving motor connected to a pivot member in the fan of the present invention oscillates in response to a counterclockwise circular motion of a crank linkage element.
Figure 9A:
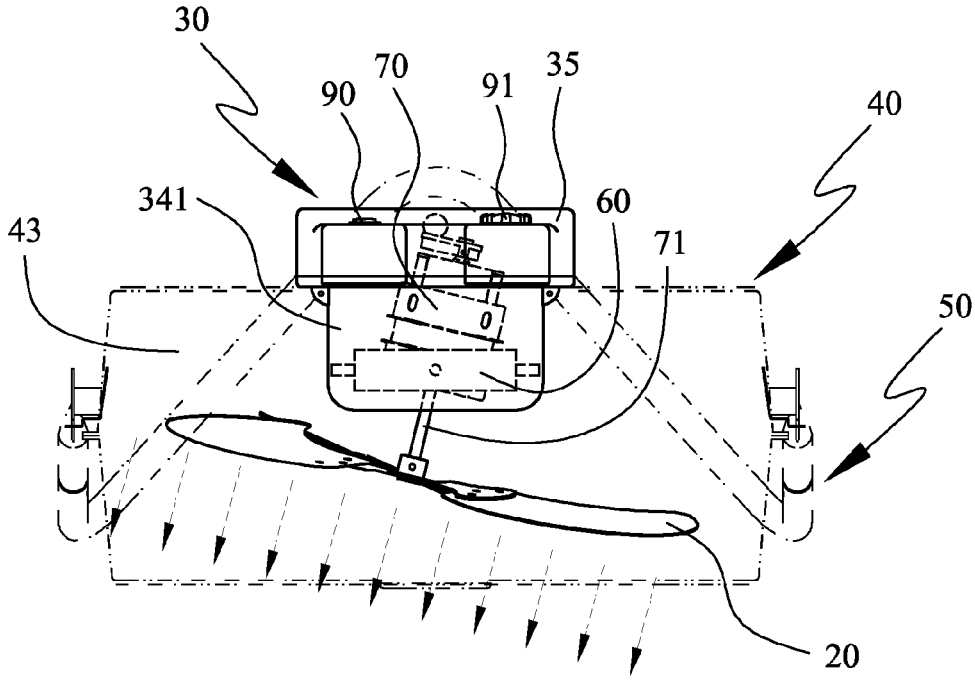
FIGS. 9A to 9D show a set of blades of the fan of the present invention is oscillated 360 degrees while rotating.
Figure 9B:
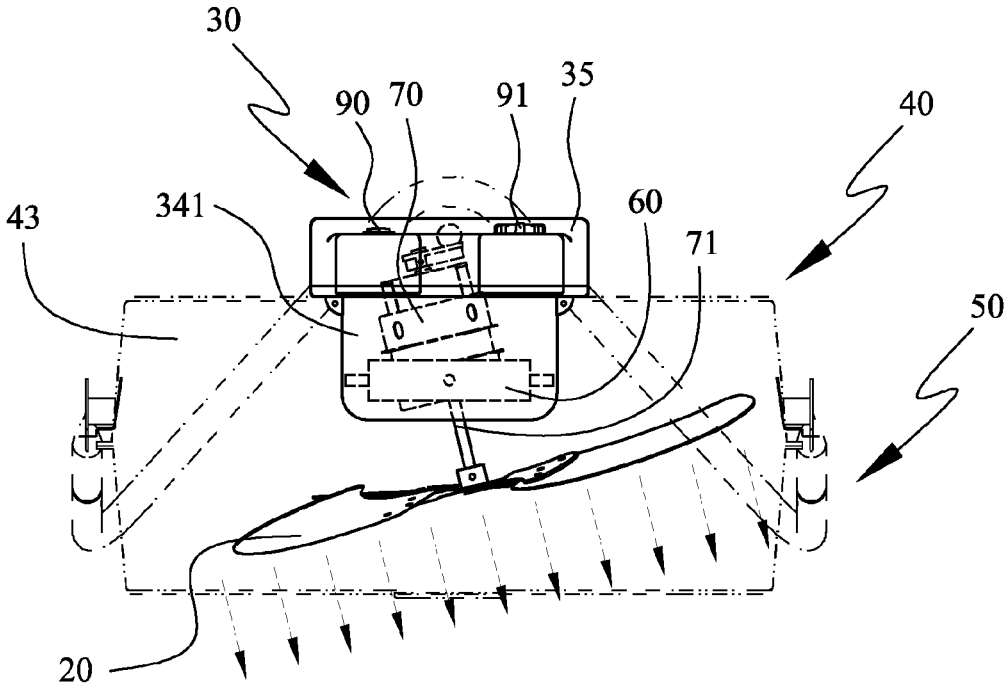
Figure 9C:
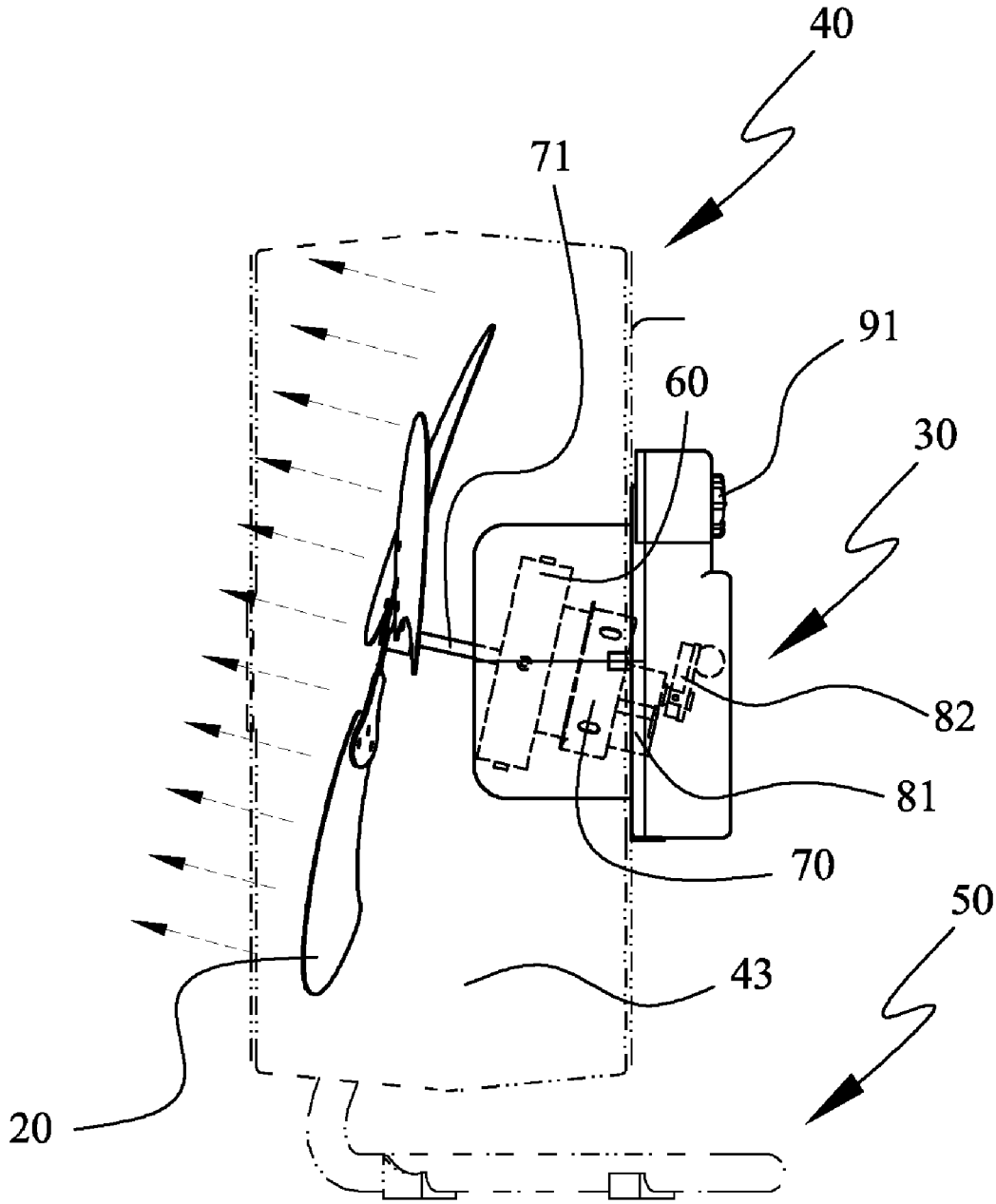
Figure 9D:
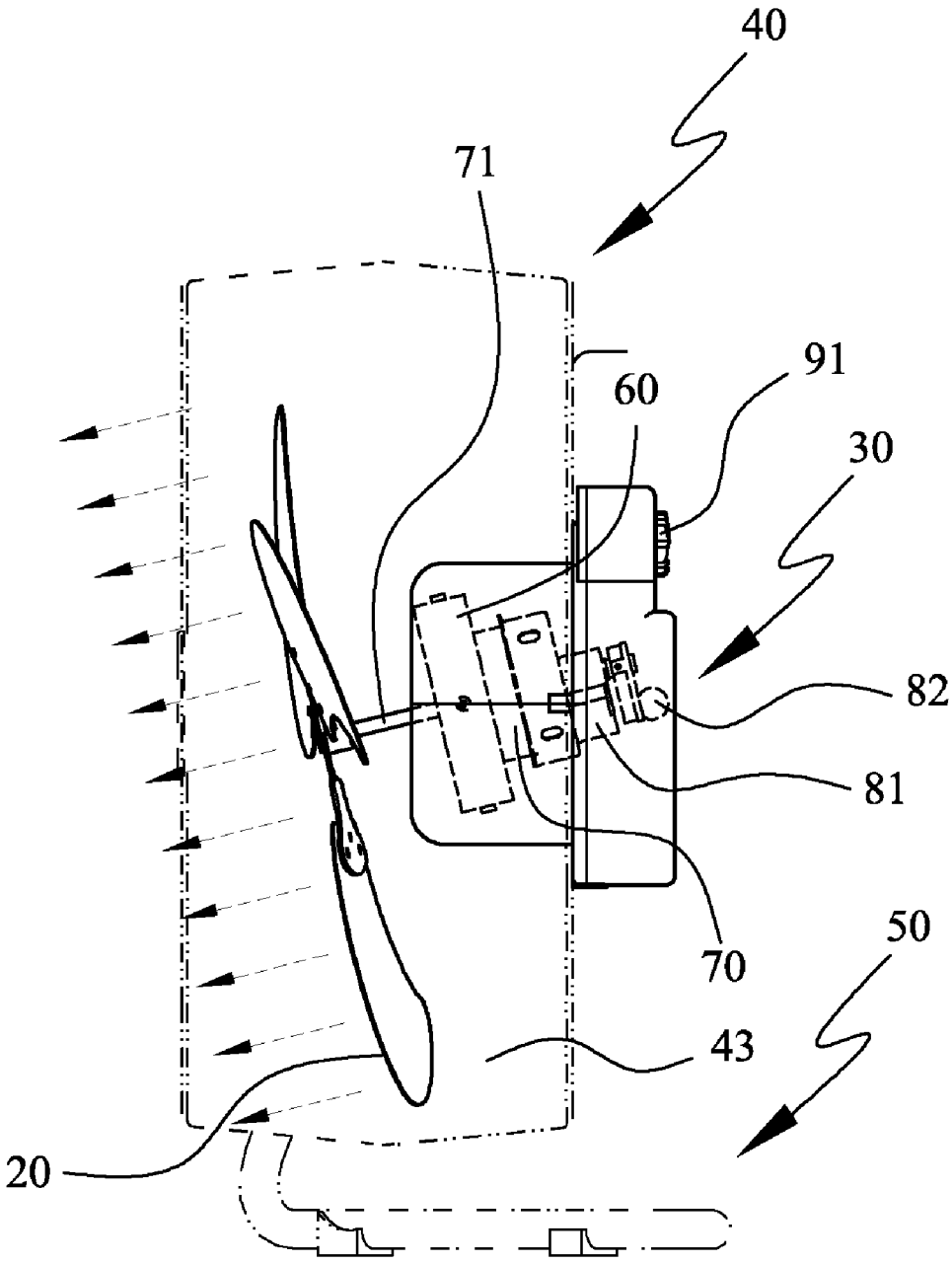

Please refer to FIG. 8. When the second driving motor 81 drives the second rotary shaft 811 to rotate, the second rotary shaft 811 in rotating will further bring the crank linkage element 82 to move in a circular motion. With the first driving motor 70 pivotally connected to the pivot member 60 via the engaged connecting rods 72 and pivot holes 63, the first rotary shaft 71 is oscillated leftward when the crank linkage element 82 is driven to swing rightward. Sequentially, the first rotary shaft 71 is oscillated downward when the crank linkage element 82 is driven to swing upward, oscillated rightward when the crank linkage element 82 is driven to swing leftward, and oscillated upward when the crank linkage element 82 is driven to swing downward. When the circular motion of the crank linkage element 82 continues, the first driving motor 70 and accordingly, the first rotary shaft 71 are brought to stably oscillate 360 degrees.

As can be seen from FIGS. 9A to 9D, with the above arrangements, the hood structure 40 of the fan of the present invention remains unmoved when the first driving motor 70 drives the set of blades 20 to rotate while oscillating 360 degrees within the oscillation space 43 defined in the hood structure 40 to achieve the purpose of directing the produced linear airflow to different directions.

In brief, the fan with concealed 360-degree oscillating mechanism according to the present invention has a first driving motor mounted to a pivot member and connected to an oscillating mechanism inside a main housing of the fan, so that a set of blades connected to the first driving motor is driven to rotate while oscillating 360 degrees to change the direction of a produced airflow. Meanwhile, since the pivot member and the crank linkage element of the oscillating mechanism together support the first driving motor to bear a centrifugal force produced by the rotating first driving motor, the fan can operate stably to reduce the stress fatigue of the oscillating mechanism, enabling upgraded airflow producing efficiency and lowered failure rate.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan with concealed 360-degree oscillating mechanism, comprising:

a main housing being provided at a front end face with an axially extended through-hole, at each of two opposite lateral inner wall surfaces with a locating element, and at an inner side of a rear end face with a coupling portion;

a pivot member being located inside the main housing and including a hollow and pivotable frame; the hollow and pivotable frame being provided at two opposite lateral sides with two corresponding and outward projected pivot shafts, and at two opposite upper and lower ends with two corresponding pivot holes; and the two pivot shafts separately engaging with the two locating elements on the main housing to allow the pivot member to vertically swing about the pivot shafts;

a first driving motor being located inside the main housing and including a first rotary shaft forward extending through the through-hole to project from the main housing, and two connecting rods corresponding to and received in the two pivot holes on the upper and lower ends of the hollow and pivotable frame to allow the first driving motor to horizontally swing about the connecting rods relative to the pivot member;

an oscillating mechanism being assembled to and between a rear end of the first driving motor and the rear end face of the main housing; the oscillating mechanism having a first end and an opposing second end, the second end of the oscillating mechanism being connected to the coupling portion on the rear end face of the main housing and being driven by the first end to rotate eccentrically; and a set of blades being fixedly connected to the first rotary shaft of the first driving motor to locate outside the main housing.

2. The fan with concealed 360-degree oscillating mechanism as claimed in claim 1, wherein the main housing is assembled from a front cover and a mating rear cover, and the front cover further includes an upper front cover and a lower front cover that together define the through-hole therebetween.

3. The fan with concealed 360-degree oscillating mechanism as claimed in claim 1, wherein the oscillating mechanism includes a second driving motor and a crank linkage element; the second driving motor being connected to the rear end of the first driving motor, and having a second rotary shaft parallel to the first rotary shaft, so that the second rotary shaft is eccentric relative to the first rotary shaft; and the crank linkage element having a first end connected to the second rotary shaft of the second driving motor and a second end assembled to the coupling portion.

4. The fan with concealed 360-degree oscillating mechanism as claimed in claim 3, wherein the crank linkage element is provided at the first end with a shaft hole for receiving the second rotary shaft therein, and at the second end with a spherical support seat, and the coupling portion is in the form of a spherical socket corresponding to the spherical support seat, whereby the spherical socket and the spherical support seat together constitute a ball-and-socket coupling.

5. The fan with concealed 360-degree oscillating mechanism as claimed in claim 3, wherein the crank linkage element is in the form of a curved link bar having a first end and an opposing second end, and the coupling portion is in the form of a connecting shaft; the curved link bar being provided at the first end with a shaft hole for receiving the second rotary shaft, and at the second end with a connecting hole for correspondingly and rotatably receiving the connecting shaft therein.

6. The fan with concealed 360-degree oscillating mechanism as claimed in claim 3, further comprising an oscillation control switch electrically connected to the second driving motor for controlling an operating state of the second driving motor.

7. The fan with concealed 360-degree oscillating mechanism as claimed in claim 6, further comprising a volume control switch electrically connected to the first driving motor for controlling a rotary speed of the set of blades.

8. The fan with concealed 360-degree oscillating mechanism as claimed in claim 7, wherein the oscillation control switch and the volume control switch are located on the rear end face of the main housing.

9. The fan with concealed 360-degree oscillating mechanism as claimed in claim 1, further comprising a hood structure being connected to and fitted around the main housing, and internally defining a forward extended oscillation space for enclosing a front portion of the main housing and the set of blades therein.

10. The fan with concealed 360-degree oscillating mechanism as claimed in claim 9, wherein the hood structure is assembled from a first hood and a second hood; the first hood being provided with a fitting opening corresponding to the main housing, so that the main housing is extended through the fitting opening and assembled to the first hood at the fitting opening; and the second hood being configured corresponding to the first hood and being assembled to a front side of the first hood to define the oscillation space between the first and the second hood.

11. The fan with concealed 360-degree oscillating mechanism as claimed in claim 9, further comprising a stand externally connected to the hood structure to stably support the fan on the stand for use.

12. The fan with concealed 360-degree oscillating mechanism as claimed in claim 11, wherein the stand includes two supporting bars being connected to two lateral sides of the hood structure, and a base being extended between lower ends of the two supporting bars to stably support and position the fan on a floor.

* * * * *